US007121964B1

(12) United States Patent
Dahm et al.

(10) Patent No.: US 7,121,964 B1
(45) Date of Patent: Oct. 17, 2006

(54) HOCKEY PUCK FACE-OFF METHOD AND APPARATUS

(75) Inventors: Winifred Dahm, Howell, MI (US); Randy Merrifield, Warren, MI (US); John Dobrzelewski, Clarkston, MI (US)

(73) Assignee: Erhard BMW, Bloomfield Hills, MI (US)

( * ) Notice: Subject to any disclaimer, the term of this patent is extended or adjusted under 35 U.S.C. 154(b) by 54 days.

(21) Appl. No.: 10/816,101

(22) Filed: Apr. 1, 2004

(51) Int. Cl.
*A63B 69/00* (2006.01)

(52) U.S. Cl. ..... 473/446

(58) Field of Classification Search ..... 473/471, 473/470, 469, 460, 455, 446; 124/16, 32, 124/46, 73, 81
See application file for complete search history.

(56) References Cited

U.S. PATENT DOCUMENTS 3,665,910 A * 5/1972 Boni ..... 124/73
3,838,676 A * 10/1974 Kehelin ..... 124/75
3,838,677 A * 10/1974 Alvares ..... 124/16
3,876,201 A * 4/1975 King ..... 473/446
3,989,027 A * 11/1976 Kahelin ..... 124/58
4,004,567 A * 1/1977 Henderson ..... 124/61
4,021,036 A * 5/1977 Nelson et al. ..... 473/459
4,607,842 A * 8/1986 Daoust ..... 473/446
5,133,330 A * 7/1992 Sharp ..... 124/56
5,647,338 A * 7/1997 Martin ..... 127/75
5,846,144 A * 12/1998 Bothers ..... 473/446
6,605,010 B1 * 8/2003 Rydza ..... 473/446

* cited by examiner

*Primary Examiner*—Eugene Kim
*Assistant Examiner*—M. Chambers
(74) *Attorney, Agent, or Firm*—Rader, Fishman & Grauer PLLC

(57) ABSTRACT

Methods and apparatuses for dropping a hockey puck (collectively the "system"). The system can facilitate or simulate hockey face-offs. Various embodiments of the system can be configured to provide convenience, portability, stability, and/or consistency for dropping a hockey puck to facilitate a hockey face-off. A frame can support a puck housing and a feed mechanism. The feed mechanism may be configured to feed the hockey puck from the puck housing to a feed chute. A release mechanism can receive the hockey puck from the feed chute. The release mechanism may be configured to release the hockey puck according to a predefined release rate. A power source can be carried by the frame and be configured to power the feed and the release of the hockey puck.

24 Claims, 10 Drawing Sheets

HOCKEY PUCK FACE-OFF METHOD AND APPARATUS

BACKGROUND OF THE INVENTION

The present methods and apparatuses relate in general to dropping a hockey puck. More specifically, the present methods and apparatuses relate to dropping a hockey puck to facilitate, simulate, or practice a hockey face-off.

A "face-off" is a significant part of the sport of hockey. In competition, a referee releases a hockey puck (also referred to as the "puck") toward a playing surface between two opposing hockey players. Preferably, the puck is released such that it is relatively flat when it contacts the playing surface so that one player does not gain an advantage due to a peculiar bounce of an undesirably oriented puck. Once the puck is released, the players quickly vie for control of the puck. Accordingly, hockey players of all ages and skill levels earnestly seek to improve their face-off skills in order to "win" more face-offs.

A number of devices have been constructed to help hockey players practice face-offs without the need for an additional person to release the puck. However, these conventional devices do not provide robust convenience, portability, stability, or consistency. For example, some conventional devices must be connected to an external power source by a power cord. Such devices are not convenient for practicing at a typical ice rink where the nearest power source may be a significant distance away from a typical face-off position. Consequently, it is not uncommon for a lengthy power cord to be cumbersomely positioned across the playing surface. Further, at some practice locations, an external power source may not be readily available.

Other conventional devices are designed to be fixedly mounted to a support structure such as a wall. Such mounted devices have several shortcomings. For example, significant effort is often required to move a mounted device. Further, an owner of a typical ice rink facility, e.g., a governmental entity, may not allow a practice device to be mounted to the walls of the facility, even temporarily. Further still, a face-off next to a wall does not accurately simulate actual face-off situations that typically occur some distance from the wall of an ice rink. For example, if a device is mounted to a wall, the wall can obstruct the players' face-off options.

Some conventional devices are not stable. For example, some devices provide bases that are not large or sturdy enough to remain stable during a face-off. When players scramble to control a released puck, such devices may be easily tipped over, thereby interfering with the face-off. Further, lack of stability can cause the pucks to be dropped in an inconsistent manner, which inconsistencies can cause undesirable results. For example, a puck may be released at a non-flat angle, thereby causing the angled puck to take a peculiar bounce off of the playing surface. The peculiar bounce may unfairly bias the face-off in favor of one player.

Other conventional hockey practice devices are not designed to simulate a face-off. For example, many conventional devices are designed to propel pucks in a horizontal or generally non-vertical direction. Such devices do not simulate face-off situations, but instead provide practice for receiving or contacting pucks that are moving laterally over a playing or practice surface. In short, conventional hockey face-off practice devices do not provide robust convenience, portability, stability, or consistency.

The existing art does not teach or even suggest a solution to the challenges identified above. There is no motivation in the art to solve the problems identified above. Furthermore, the approaches of the existing art affirmatively teach away from a comprehensive solution to such obstacles.

SUMMARY OF THE INVENTION

The present methods and apparatuses relate in general to dropping a hockey puck. More specifically, the present methods and apparatuses relate to dropping a hockey puck to facilitate, simulate, or practice a hockey face-off. Various embodiments of the methods and apparatuses can be configured to provide convenience, portability, stability, and/or consistency for dropping a hockey puck to facilitate a hockey face-off.

In some embodiments, a frame can support a puck housing component ("puck housing") and a feed mechanism. The feed mechanism may be configured to feed the hockey puck from the puck housing to a feed chute. A release mechanism can receive the hockey puck from the feed chute. The release mechanism may be configured to release the hockey puck according to a release rate. In some embodiments, the release rate is predefined by the operator of the device. A power source can be carried by the frame and be configured to power the feed and the release of the hockey puck.

In some embodiments, a hockey puck can be fed from a puck housing to a release mechanism. The hockey puck can be received and leveled at the release mechanism, including extending a stopper to receive the hockey puck. The hockey puck can be secured, including extending a gripper to secure the hockey puck. The stoppers can retract. The hockey puck may be released at a predetermined interval after the stoppers retract.

BRIEF DESCRIPTION OF THE DRAWINGS

Certain embodiments of the present apparatuses and methods will now be described, by way of examples, with reference to the accompanying drawings, in which.

DETAILED DESCRIPTION

I. INTRODUCTION OF ELEMENTS AND DEFINITIONS

The present methods and apparatuses relate in general to dropping a hockey puck. More specifically, the present methods and apparatuses relate to dropping a hockey puck to facilitate a hockey face-off.

Figure 1:
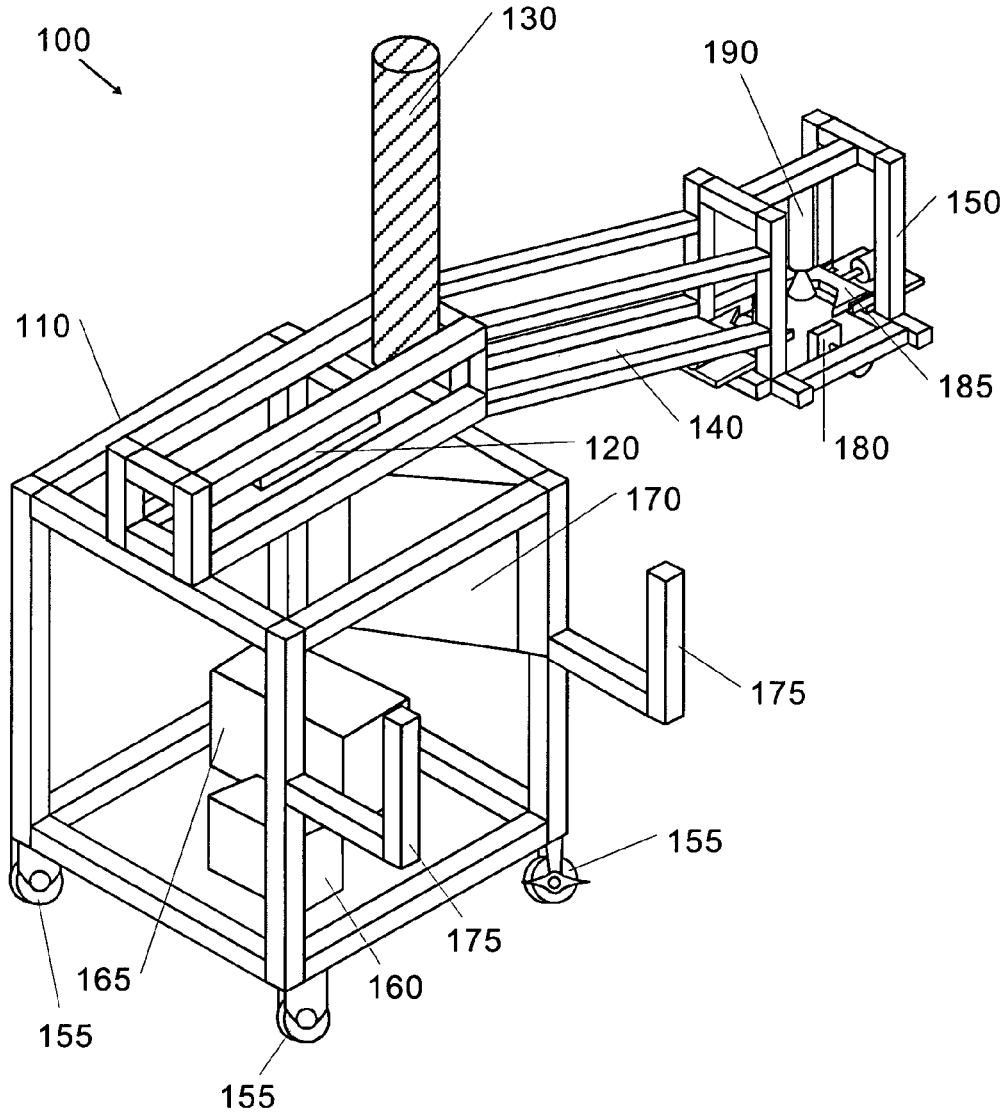
FIG. 1 is a perspective view diagram illustrating an example of a hockey face-off apparatus.

Referring now to the drawings, FIG. 1 is a perspective view of a hockey face-off apparatus (the "apparatus") 100. The apparatus 100 can include a wide variety of different components and configurations. The apparatus 100 in FIG. 1 includes: a frame 110; a feed mechanism 120 coupled to or otherwise in contact with said frame 110, a puck housing component ("puck housing") 130 coupled to or otherwise in contact with said frame 110; a feed chute 140 coupled to or otherwise in contact with said frame 110; and a release assembly 150 coupled to or otherwise in contact with said feed chute 140. The apparatus 100 further includes: wheels 155 configured to support the frame 110; a compressor 160, a power source 165, and a control unit 170 supported by the frame 110; and a stow assembly 175 coupled to the frame 110. As shown in FIG. 1, the release assembly 150 can include a stopper 180, a gripper 185, and a puck dropper 190. Each of these elements is discussed in more detail below.

A. FRAME

The frame 110 can be configured for positioning on a support surface. Preferably, the frame 110 may be positioned on a generally horizontal surface such as a playing surface comprising ice. The frame 110 can be configured to stand alone without tipping during operation. As shown in FIG. 1, the frame 110 may comprise beams arranged to help prevent the apparatus 100 from tipping. The beams should comprise a structurally strong material, such as aluminum, steel, and the like.

The frame 110 can be arranged in a wide variety of configurations by operators of the apparatus that are capable of supporting certain elements of the apparatus 100. In other words, the apparatus 100 may be self-contained. As shown in FIG. 1, the frame 110 can support the feed mechanism 120, the puck housing 130, the feed chute 140, the release assembly 150, the air compressor 160 (also referred to as the "compressor 160"), the power source 165, the control unit 170, and the stow assembly 175. In FIG. 1, the frame 110 comprises beams are arranged to form a generally three-dimensional shape capable of supporting elements of the apparatus 100. A wide variety of different support structures can perform the functionality of the frame 110.

By being configured to support the various components mentioned above, the frame 110 is portable. Accordingly, the apparatus 100 can be configured to be self-contained to enhance its portability. In addition, as shown in FIG. 1, the frame 110 may be supported by the wheels 155 or other components to further enhance its portability.

The frame 110 may form generally horizontal surfaces capable of supporting certain elements of the apparatus. As shown in FIG. 1, the frame 110 defines a generally horizontal area that is used to support the compressor 160 and the power source 165. The frame 110 of FIG. 1 also forms a generally horizontal surface for receiving a puck from the puck housing 130. The feed mechanism 120 may be positioned proximate to this position for feeding the puck toward the feed chute 140.

B. POWER SOURCE

The power source 165 can be supported and/or housed by the frame 110. As shown if FIG. 1, the power source 165 may rest on and/or be fixed to a horizontal surface of the frame 110. Accordingly, in some embodiments, the power source 165 is onboard the apparatus 100, eliminating the need for an external power supply. The power source 165 may comprise any device capable of supplying sufficient power to the apparatus 100, such as a battery.

C. COMPRESSOR

The compressor 160 can be supported and/or housed by the frame 110. As shown in FIG. 1, the power source 165 may rest on and/or be fixed to a horizontal surface of the frame 110. Accordingly, in some embodiments, the compressor 160 is on-board the apparatus, eliminating the need for an external air compressor.

The compressor 160 can comprise any device capable of generating sufficient air pressure for operation of the apparatus 100. The compressor 160 will be further discussed below in relation to the control unit 170.

D. STOW ASSEMBLY

The stow assembly 175 can be coupled to the frame 110 and configured to stow the removable feed chute 140 and the release assembly 150. The feed chute 140 and the release assembly 150 will be discussed in detail below. As shown in FIG. 1, the stow assembly 175 may comprise a number of beams extending from the frame 110 and configured to support the feed chute 140. The beams can support the feed chute 140 in a stow position.

E. FEED MECHANISM

The feed mechanism 120 can include any mechanism capable of causing a puck to enter the feed chute 140. For example, the feed mechanism 120 may comprise an actuator, e.g., a pneumatic actuator or solenoid, capable of feeding the puck to the feed chute 140. In a preferred embodiment, the feed mechanism 120 comprises an actuator configured to extend to push the puck toward the feed chute 140.

As shown in FIG. 1, the feed mechanism 120 may be coupled to the frame 110 at a position proximate to the bottom end of the puck housing 130. Preferably, the feed mechanism 120 and puck housing 130 are configured such that only one puck at a time can be fed to the feed chute. For example, the feed mechanism 120 can be configured to push the bottom-most puck out from under the puck housing 130 and toward the feed chute 140. Accordingly, the puck housing 130 should be positioned at an appropriate height above a generally horizontal surface such that the feed mechanism 120 feeds one puck at a time to the feed chute 140.

The feed mechanism 120 can be configured to accelerate pucks at a specific feed rate. Accordingly, the feed mechanism 120 may be controlled by the control unit 170, and the control unit 170 may determine the feed rate. The control unit 170 and the feed rate are discussed below.

F. PUCK HOUSING

The puck housing 130 can be configured to house a number of pucks. As shown in FIG. 1, the puck housing 130 may include a generally tube-shaped cylinder of appropriate size to house the pucks. The puck housing 130 should include open ends such that pucks may be inserted into the puck housing 130 at one end and exit, in turn, at the other end. Preferably, the puck housing 130 is shaped to help orient the pucks in generally transverse positions. Accordingly, the pucks can be arranged in the puck housing 130 as a stack of transversely-oriented pucks.

The puck housing 130 can include any structure capable of guiding the pucks toward the feed mechanism 120 and/or the feed chute 140. As shown in FIG. 1, the puck housing 130 can be coupled to or otherwise in contact with the frame 110 at a generally vertical orientation. Such an orientation utilizes gravity to help guide the pucks generally downward toward the feed mechanism 120. Other mechanisms, e.g., a spring, can also be used to bias the pucks toward the feed mechanism 120.

As mentioned above, the exit end of the puck housing 130 shown in FIG. 1 can preferably be positioned a certain distance above a horizontal surface of the frame 110. Accordingly, the bottom-most puck of the puck housing 130 may descend toward the feed mechanism 120, exit the puck housing, and rest upon the horizontal surface at a position proximate to the feed mechanism 120. Preferably, the puck housing 130 is positioned at a certain distance from the horizontal surface such that the bottom-most puck has completely exited the puck housing 130 as it rests on the horizontal surface, while the puck just above the bottom-most puck has not completely exited the puck housing 130 as the bottom-most puck rests on the horizontal surface. This allows the feed mechanism 120 to push only the bottom-most puck out from under the puck housing 130. The feed mechanism 120 then retracts and the next puck in the puck housing 130 descends until it rests on the horizontal surface and becomes the new bottom-most puck of the stack. The feed mechanism 120 can then repeat the process by accelerating the new bottom-most puck toward the feed chute 140.

G. FEED CHUTE

The feed chute 140 can comprise any mechanism configured to facilitate delivery of a puck from the puck housing 130 area to the release assembly 150. As shown in FIG. 1, the feed chute 140 can comprise a first end coupled to the frame 110 and a second end extending generally laterally away from the frame 110. The second end can be coupled to the release assembly 150. The first end should be coupled to the frame 110 such that when the feed mechanism 120 actuates, the first end can receive the puck being fed to the feed chute 140.

Upon receiving the puck, the feed chute 140 should help deliver the puck to the release assembly 150. In FIG. 1, the feed chute 140 is sloped generally downward as it extends away from the frame 110. The generally downward slope utilizes gravity to cause the puck to travel toward the release assembly 150. Alternatively, other forces may be used to cause the puck to move, such as a conveyor or spring mechanism.

As shown in FIG. 1, the feed chute 140 may comprise beams spanned by a surface capable of carrying and guiding the puck as it travels toward the release assembly 150. The surface should be conducive to movement of the puck toward the release assembly 150. The beams may be elevated in relation to the surface to prevent the puck from prematurely exiting the feed chute 140.

Further, the feed chute 140 may be removable. In other words, the feed chute 140 can be decoupled from the frame 110. This allows the apparatus 100 to be configured for convenient travel or stowage. As discussed above, the feed chute 140 can be configured for stowage at the stow assembly 175.

Figure 2:
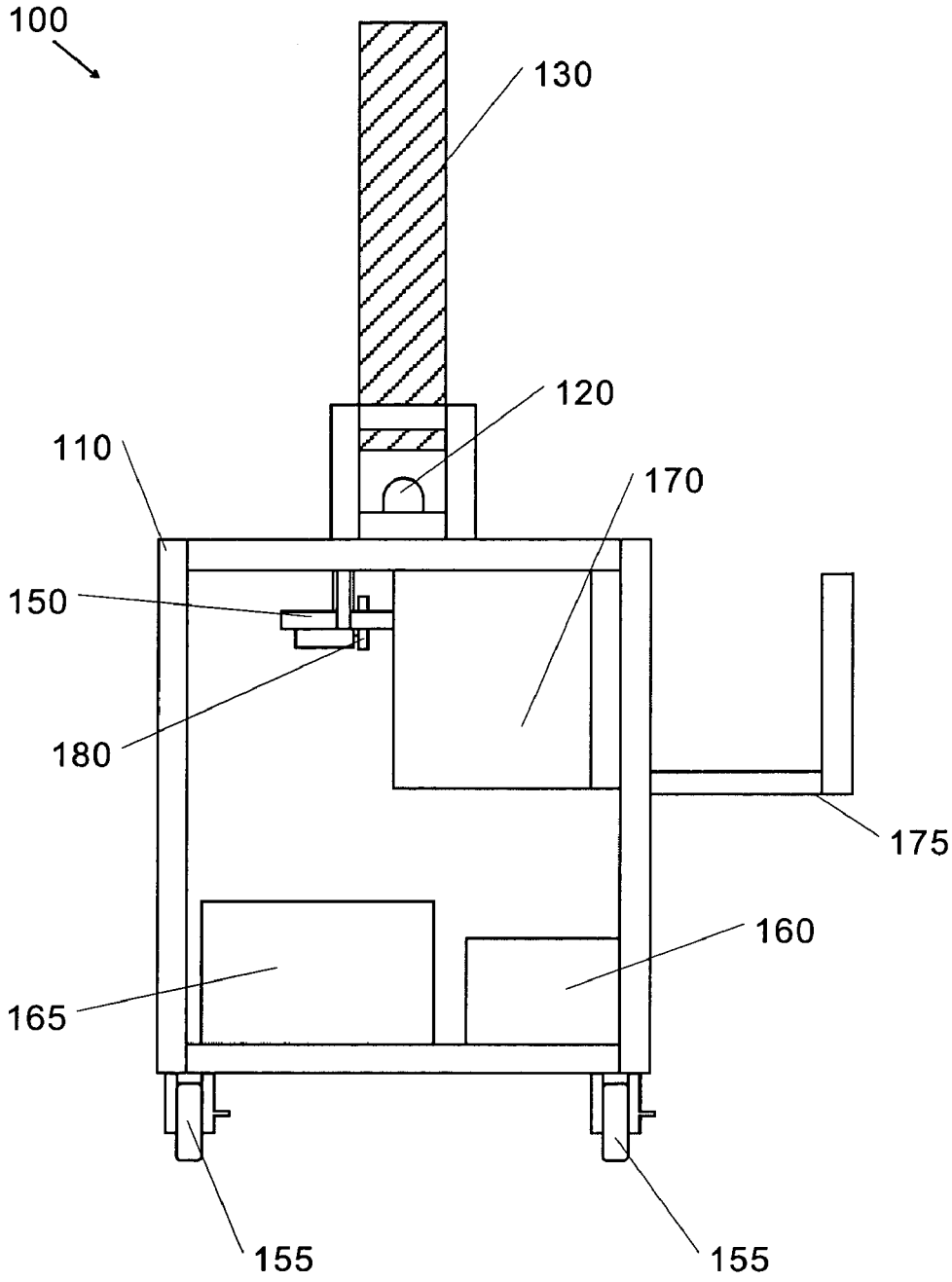
FIG. 2 is a rear-view diagram illustrating an example of a hockey face-off apparatus.
Figure 3:
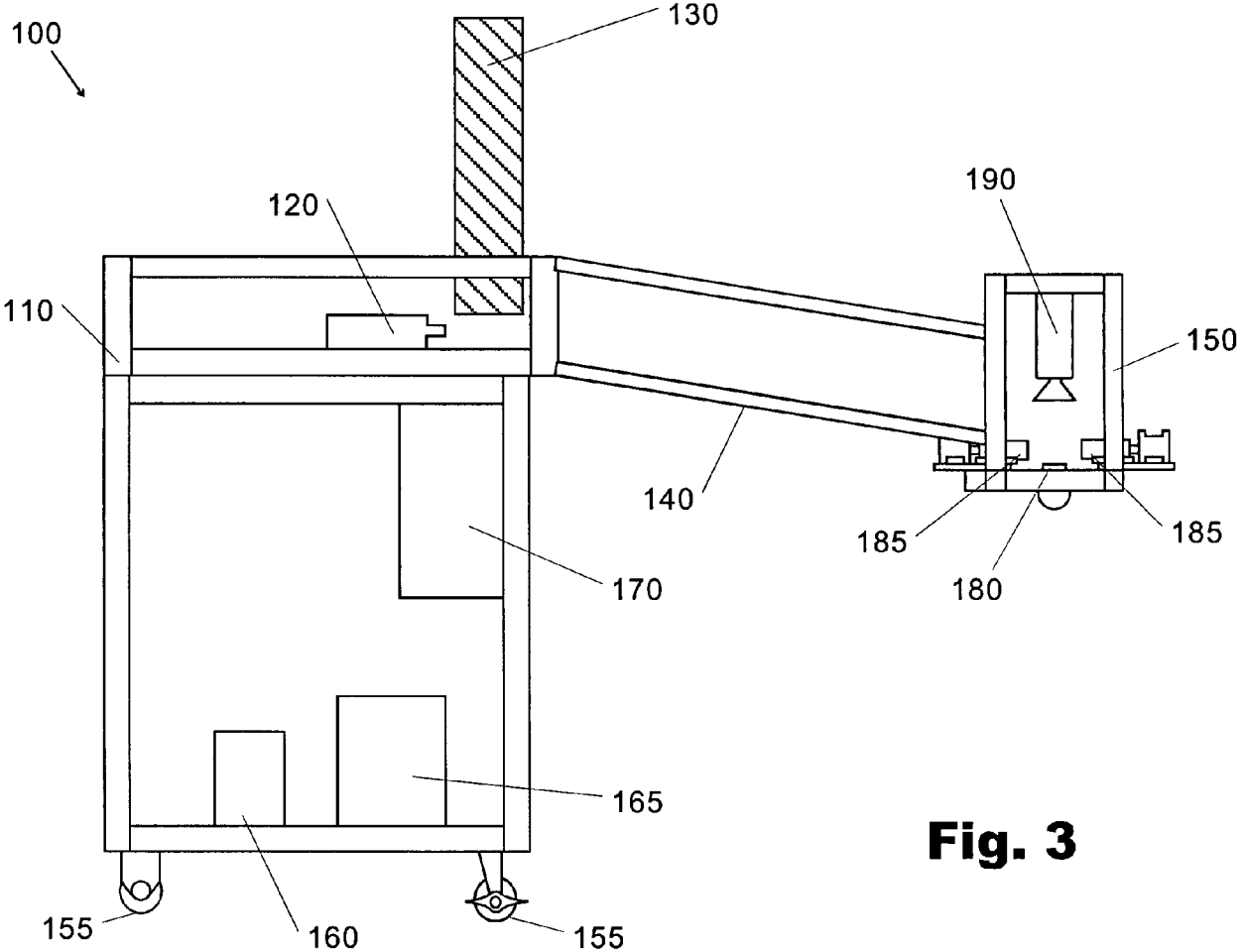
FIG. 3 is a side-view diagram illustrating an example of a hockey face-off apparatus.
Figure 4:
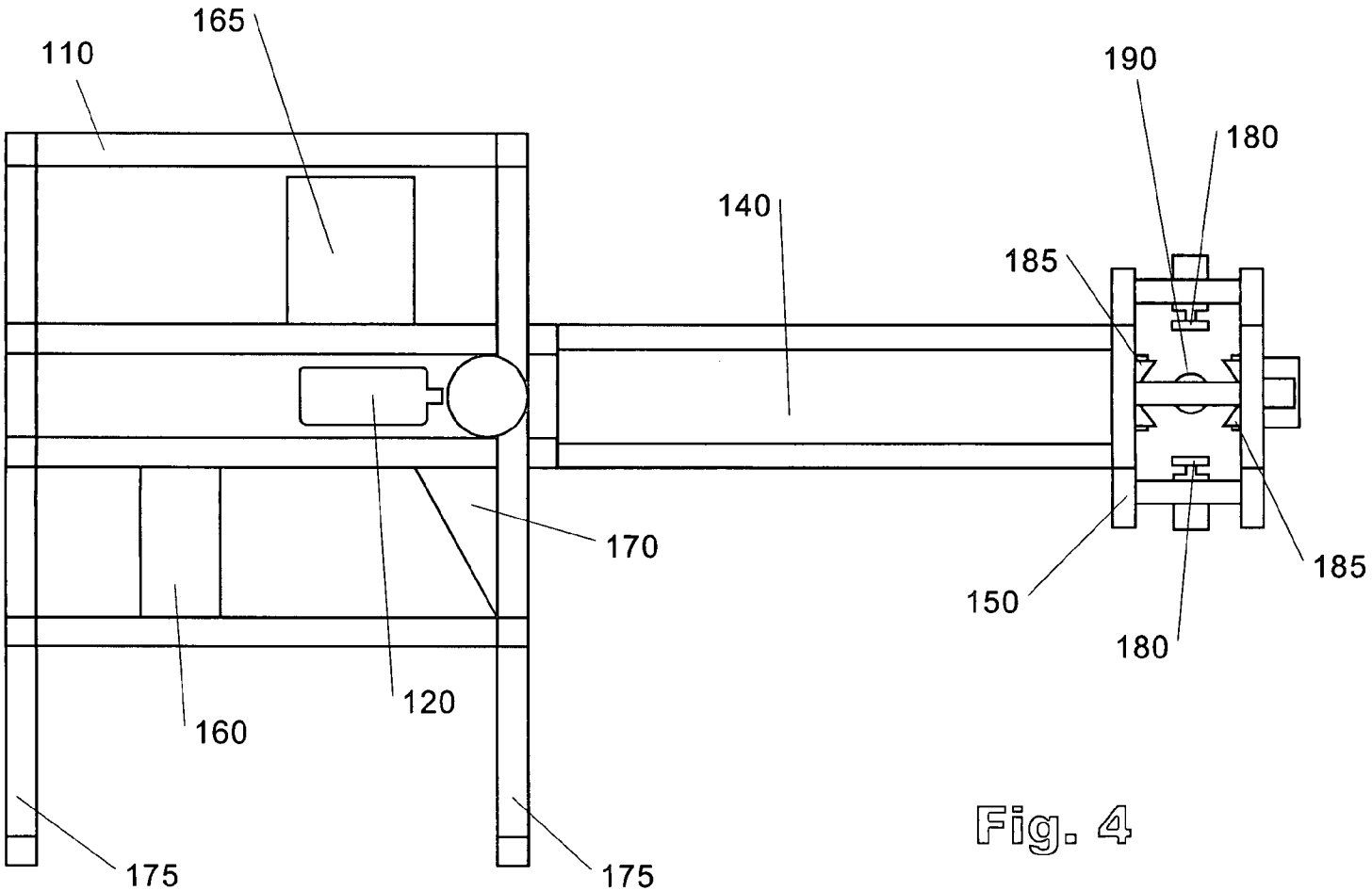
FIG. 4 is a top-view diagram illustrating an example of a hockey face-off apparatus.

By being configured to extend away from the frame 110, the feed chute 140 can position the release assembly 150 so that the release assembly 150 is no closer to the frame 110 than a predetermined distance. In preferred embodiments, the operator of the apparatus 100 can select the predetermined distance from a range of available distances. The distance between the release assembly 150 and the frame 110 allows the puck to be released over a playing surface at some distance away from the frame 110, thereby providing an open drop zone for simulating a hockey face-off. FIGS. 2-4 show a rear-view, a side-view, and a top-view of the apparatus 100 of FIG. 1.

H. RELEASE ASSEMBLY

Figure 5:
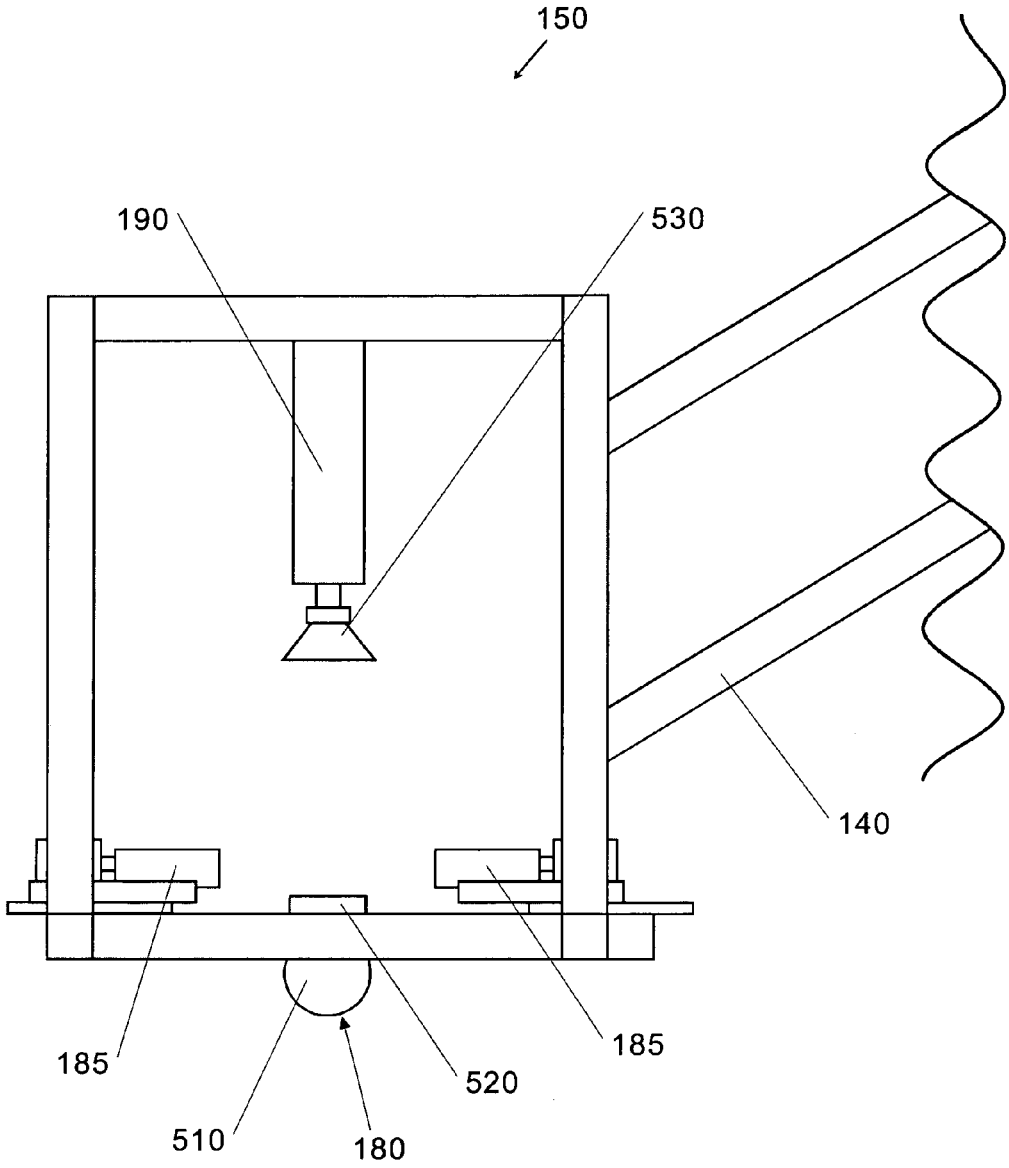
FIG. 5 is a side-view diagram illustrating an example of a release assembly for a hockey face-off apparatus with grippers in a generally open position.

FIG. 5 shows a side-view diagram illustrating an example of the release mechanism 150 for the apparatus 100. As shown in FIG. 5, the release assembly 150 may be positioned to receive the puck from the feed chute 140. Once the puck has been received, the release assembly 150 can release the puck at approximately a predetermined interval. As shown in FIG. 5, the release assembly 150 may include a frame structure configured to support the stopper mechanism 180 (also referred to as the "stoppers 180") and the gripper mechanism 185 (also referred to as the "grippers 185"). The stoppers 180 and the grippers 185 should be configured to work together to receive and release the puck. In some embodiments, the gripper mechanism 185 and the stopper mechanism 180 comprise pneumatic actuators or solenoids. The apparatus can incorporate grippers 185 and stoppers 180 made up of a wide variety of different materials and sub-components.

The stopper mechanism 180 can be configured to receive the puck. The stopper mechanism 180 may comprise a number of stopper actuators 510 configured to cause support plates 520 to extend and retract. As shown in FIG. 4, the release assembly 150 can comprise two stoppers 180 positioned for receiving the puck. Before the puck enters the release assembly 150 from the feed chute 140, the support plates 520 of the stoppers 180 should extend to positions for catching the puck. The support plates 520 may be positioned at a height that allows the puck to come to rest on the extended support plates 520.

In some embodiments, a mechanism may be provided to help catch the puck by stopping the lateral momentum of the puck as it enters the release assembly 150 from the feed chute 140. For example, the gripper mechanism 185 can be configured to function as a backstop to help stop the lateral momentum of the puck. When a backstop is provided, the puck should still come to rest on the extended support plates 520 of the stopper mechanism 180.

Preferably, the support plates 520 help level the puck with respect to a surface that is either generally horizontal or in a preferred embodiment, substantially horizontal. Accordingly, the support plates 520 may form generally horizontal surfaces upon which the puck can rest at a generally horizontal orientation, which is desirable for simulating a hockey face-off environment.

Figure 6:
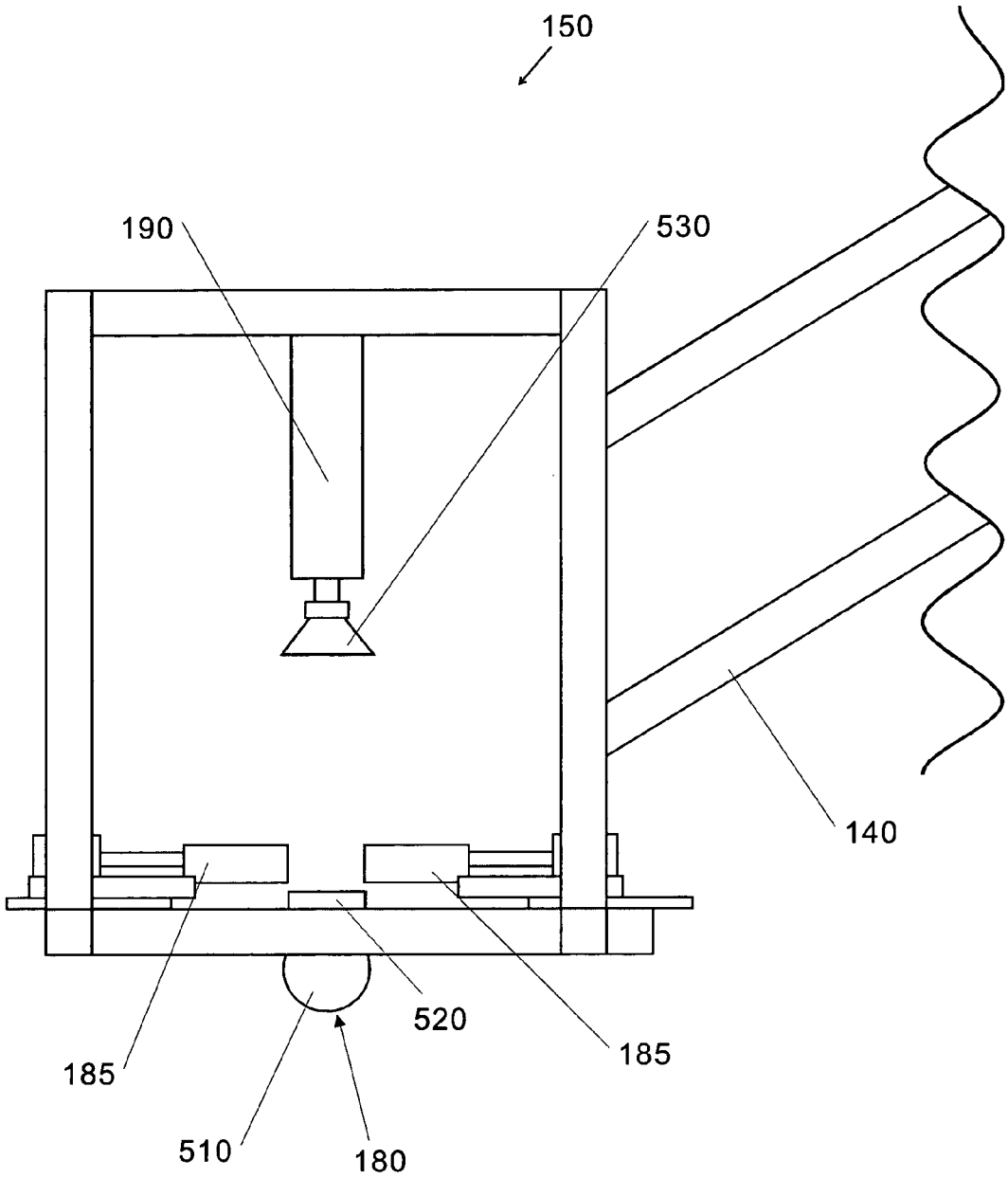
FIG. 6 is a side-view diagram illustrating an example of a release assembly for a hockey face-off apparatus with the grippers in a generally closed position.

Once the puck is at rest on the support plates 520 of the stopper mechanism 180, the gripper mechanism 185 can extend to secure the puck. As shown in FIG. 5, the gripper mechanism 185 may comprise two oppositely positioned grippers 185 that can be extended and retracted by actuators. FIG. 5 shows the grippers 185 in a generally "open" position. When the puck is at rest on the support plates 520, the grippers 185 may extend to a generally "closed" position as shown in FIG. 6. By so extending, the grippers 185 secure the puck by the sides of the puck.

The grippers 185 can be configured to center the puck. Preferably, when the grippers 185 extend to secure the puck, the grippers 185 position the puck to be generally centered with respect to the puck dropper 190. This enables the puck dropper 190 to apply a force to the puck in such a way that the puck can maintain a generally level orientation as it falls toward a playing surface. Preferably, the grippers 185 consistently place each puck in substantially the same position with respect to the puck dropper 190.

The grippers 185 can be shaped to facilitate the centering of the puck. As shown in FIGS. 1 and 4, the grippers 185 may comprise oppositely positioned sloped surfaces. For example, the sloped surfaces may form a general V-shape, U-shape, or other shape capable of centering the puck as the grippers 185 extend. When the grippers 185 extend to secure the puck, the sloped surfaces cause the puck to move toward a predetermined position. Accordingly, each puck can be positioned at approximately the predetermined position.

After the grippers 185 have secured the puck, the stoppers 180 can retract out from underneath the puck. The stoppers 180 should allow the grippers 185 a sufficient time to secure the puck before retracting. By the retracting process, the stoppers 180 clear an area beneath the puck to allow the puck to fall toward a playing surface upon being released.

The grippers 185 can retract to release the puck. In some embodiments, the puck is dropped toward the playing surface when the grippers 185 retract. In other embodiments, another mechanism, such as the puck dropper 190, is configured to drop the puck towards the playing surface after the grippers 185 have retracted.

Preferably, the grippers 185 retract after a predetermined interval of time that corresponds with a selected or predetermined release rate. The release rate can be variable such that the pucks can be released after different predetermined intervals. The predetermined interval can be a certain amount of time measured from some event. For example, the predetermined interval can comprise an amount of time after the stoppers 180 retract or after the grippers 185 extend. The timing of the extension and retraction of the stoppers 180 and the grippers 185 are controlled by the control unit 170, which is discussed in further detail below.

I. PUCK DROPPER

The puck dropper 190 can be configured to drop the puck toward the playing surface. Accordingly, the puck dropper 190 can comprise any mechanism capable of releasing the puck toward the playing surface. For example, the puck dropper 190 may include but is in no way limited to a pneumatic actuator, a solenoid, a vacuum generator, a quick exhaust mechanism, and an air blaster. Preferably, the puck dropper 190 accelerates the puck toward the playing surface while also helping to maintain the generally horizontal orientation of the puck.

In some embodiments, the puck dropper 190 is configured to form a vacuum to secure the puck, and then destroy the vacuum to release the puck. For example, FIG. 5 shows the puck dropper 190 having a suction member 530. Once the grippers 185 have secured the puck, the suction member 530 may extend to contact the upper surface of the puck. A vacuum can then be formed between the suction member 530 and the puck. Once the vacuum is formed, the grippers 185 may retract such that the puck is suspended from the suction member 530. The suction member 530 may retract to raise the puck. At this position, the puck is ready to be dropped toward the playing surface. The dropping of the puck can include the puck dropper 190 accelerating the puck toward the playing surface.

The puck dropper 190 can release the puck by destroying the vacuum. In particular, the puck dropper 190 may blast a gas, such as air, through the suction member 530 toward the puck to destroy the vacuum, thereby releasing the puck. Further, the blast of air can apply a force on the puck to accelerate the puck toward the playing surface. In addition, the suction member 530 may extend to push the puck toward the playing surface. The timing of the first extension, vacuum formation, retraction, vacuum destruction, and second extension can be controlled by the control unit 170, which is discussed in further detail below.

Preferably, the puck dropper 190 applies a force to the puck such that the puck can maintain a generally level orientation as it descends toward the playing surface. As discussed above, the grippers 185 can center the puck in relation to the puck dropper 190. This allows the force applied by the puck dropper 190 to be centralized with respect to the puck so that the force does not cause the puck to rotate as it descends.

While the puck dropper 190 is helpful for accelerating a puck toward the playing surface to facilitate a hockey face-off, some embodiments of the apparatus 100 do not include the puck dropper 190. In such embodiments, the puck can be caused to free fall toward the playing surface when the grippers 185 retract to release the puck.

J. CONTROL UNIT

As shown in FIG. 1, the control unit 170 may be coupled to the frame 110. The control unit 170 can comprise a housing configured to house a control system. Further, the control unit 170 may include an interface configured to allow a user (e.g. operator) of the apparatus 100 to access and adjust the control system. The control system of the control unit 170 can be powered by the power source 165.

Figure 7:
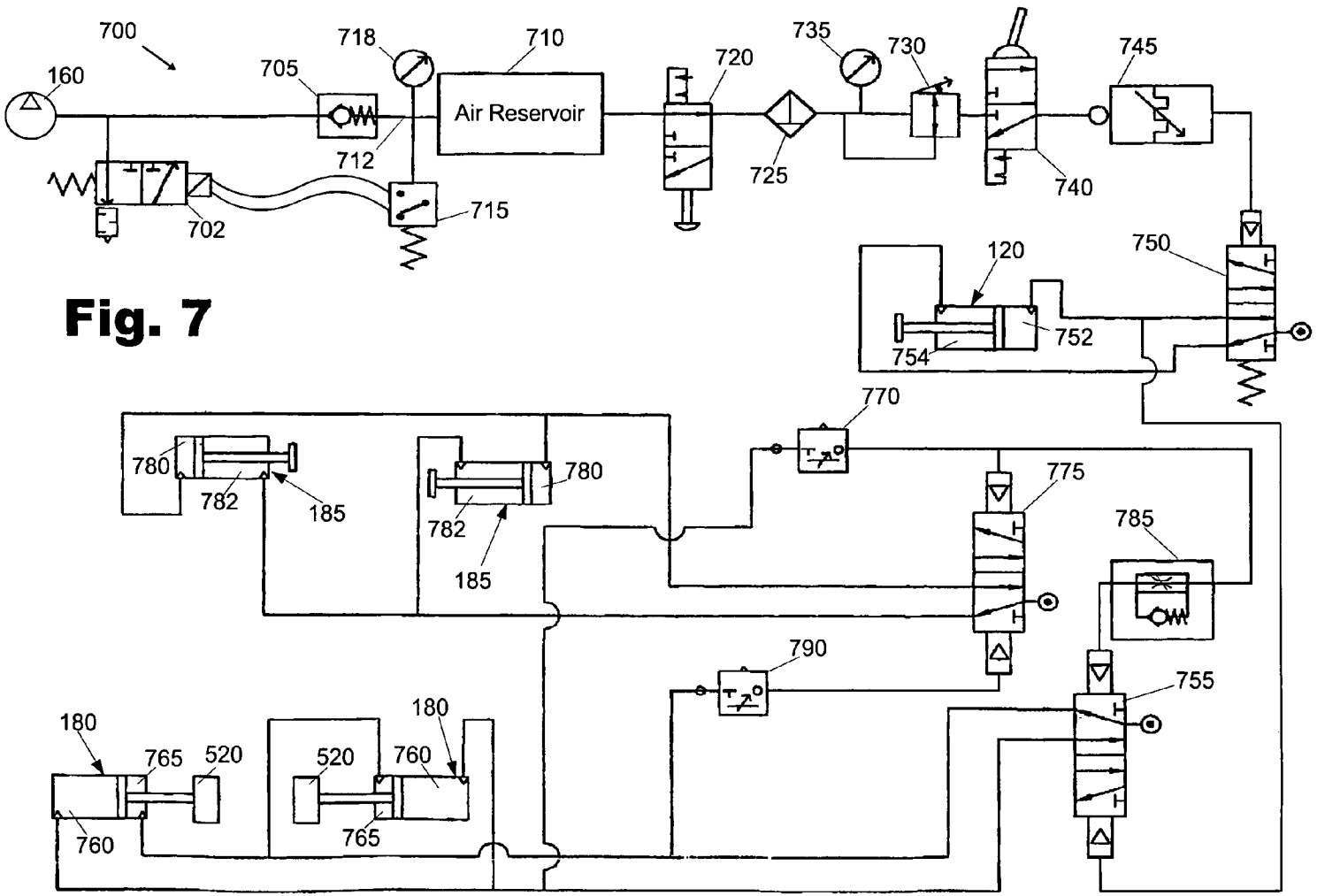
FIG. 7 is a circuit diagram illustrating an example of a control system and connected actuators.

FIG. 7 shows a control system 700 according to one embodiment of the apparatus 100. As shown in FIG. 7, the compressor 160 may be coupled to a dump valve 702 and a check valve 705. The compressor 160, the check valve 705, and an air reservoir 710 may be coupled together to form a volume chamber 712. Accordingly, the compressor 160 can build and maintain air pressure within the volume chamber 712 and the air reservoir 710. The volume chamber 712 can hold air such that air pressure can be built up within the volume chamber 712. The volume chamber 712 couples a number of components of the control system 700 together such that air pressure can be provided to the components, which components will be described below.

The check valve 705 can affect the air pressure within the volume chamber 712 and the air reservoir 710. For example, the check valve 705 may be configured to maintain residual pressure in the volume chamber 712 by preventing backflow of air when the apparatus 100 is not operating. Further, the check valve 705 may help maintain an appropriate range of air pressure in the volume chamber 712 when the apparatus 100 is operating. For example, if the air pressure exceeds a predetermined threshold, the check valve 705 may open to reduce the air pressure.

The dump valve 702 can affect the air pressure between the compressor 160 and the check valve 705. When the apparatus 100 is not operating, the dump valve 702 is normally open. Consequently, the compressor 160 can start up without a pressure load against it. Once the compressor 160 has begun to operate, the dump valve 702 should close to allow air pressure to be increased or maintained in the volume chamber 712. Further, the dump valve 702 may open during operation of the apparatus 100 to lower the air pressure or to stop the air pressure in the volume chamber 712 from being increased. For example, if the air pressure of the volume chamber 712 exceeds a predetermined threshold, the dump valve 702 may open to help lower the air pressure.

A pressure switch 715 and a pressure sensor 718 can be connected to the volume chamber 712 or the air reservoir 710 to help control air pressure by controlling the operation of the dump valve 702 and the compressor 160. As shown in FIG. 7, the pressure switch 715 and the pressure sensor 718 may be coupled to volume chamber 712. The pressure sensor 718 can then measure the air pressure of the volume chamber 712. The pressure switch 715 is configured to switch according to the measured air pressure. Specifically, the pressure switch 715 can turn off the compressor 160 and/or open the dump valve 702 when air pressure reaches a maximum predetermined threshold. Conversely, the pressure switch 715 can turn on the compressor 160 and/or close the dump valve 702 when the air pressure falls below a minimum predetermined threshold. Thus, the pressure switch 715 and the pressure sensor 718 can help maintain the air pressure of the volume chamber 712 and the air reservoir 710 within predetermined boundaries while the apparatus 100 is operating, thereby maintaining an optimum operating air pressure. In a preferred embodiment, the predetermined range of operating air pressure is approximately 50 pounds per square inch (PSI) to 80 PSI (3,447–5,516 millibars).

The air reservoir 710 can be coupled to an emergency switch 720 and an emergency valve 725. The emergency valve 725 should normally be open to allow air to flow from the air reservoir 710 to a regulator 730. This allows air to flow from the air reservoir 710 to help increase or maintain air pressure at the regulator 730.

The emergency switch 720 can be actuated by the user of the apparatus 100. If the emergency switch 720 is actuated during operation of the apparatus 100, the emergency valve 725 closes so that air cannot flow from the air reservoir 710 to the regulator 730. Accordingly, the forward components of the system 700 should exhaust air up to the emergency valve 725 and stop cycling when the air pressure becomes less than some threshold.

The regulator 730 can control the air pressure available to the forward components of the system 700. As shown in FIG. 7, the regulator 730 may be coupled to a gauge 735 that can determine the air pressure of the volume chamber 712 at or near the regulator 730. The gauge 735 provides data representative of the air pressure to the regulator 730. The regulator 730 can be configured to adjust the air pressure to help maintain a predetermined optimum air pressure available to the forward components of the control system 700. For example, the regulator 730 may be configured to maintain the air pressure measured by the gauge 735 at approximately 40 PSI (2,758 millibars). If the measured air pressure is greater than approximately the optimum air pressure, the regulator 730 can increase a rate of release of the air from the system 700. Conversely, if the measured air pressure is less than approximately the optimum air pressure, the regulator 730 may decrease the rate of release and/or allow more air to flow to the forward components to help increase air pressure. Preferably, the regulator 730 helps prevent a backflow of air from the forward components of the system 100 toward the air reservoir 710.

The regulator 730 can be coupled to a feed switch 740. The feed switch should be accessible to the user. When the feed switch 740 is in an "on" position, the control system 700 cycles. When the feed switch 740 is in the "on" position, air can flow from the regulator 730 to the forward components of the system 700, including a pulse generator 745 that may be coupled to the feed switch 740. When the feed switch 740 is in an "off" position, air should not easily flow from the regulator 730 to the pulse generator 745. For example, if the system 700 is operating and the feed switch 740 is placed in the "off" position, air will substantially stop flowing from the regulator 730 to the pulse generator 745. The pulse generator 745 should then complete its last cycle with the remaining available air. Once the air pressure becomes less than approximately some threshold, the system 700 should stop cycling.

When the power source 165 is providing power and the feed switch 740 is actuated to the "on" position, the compressor 160 charges the control system 700 to approximately an optimum operating pressure. Once the optimum pressure has been reached, the pressure switch 715 turns "off" the compressor 160 to generally stop the buildup of air pressure caused by the compressor 160. The pulse generator 745 begins operating when the feed switch 740 is switched to the "on" position.

As the pulse generator 745 operates, it sends a pulse signal to other components of the control system 700. The pulse signal is sent at a specific frequency representative of a feed rate. The feed rate defines a rate at which the pucks are fed to the feed chute 140 as discussed above. The feed rate may be variable, allowing the user to determine the feed rate. In some embodiments, the feed rate is approximately ten seconds.

As shown in FIG. 7, the pulse generator 745 can be coupled to a feed valve 750. The feed valve 750 should be configured to toggle according to a characteristic of the pulse signal. Accordingly, the feed valve 750 should toggle based on the feed rate represented by the pulse signal. As the feed valve 750 toggles, it controls connections of the volume chamber 712 to certain forward components. For example, the feed valve 750 may connect a subset of forward components of the control system 700 to the volume chamber 712, while disconnecting other forward components of the system 700 from the volume chamber 712.

When the feed valve 750 toggles responsive to the pulse signal, the feed mechanism 120 can be actuated. As shown in FIG. 7, the feed valve 750 may be coupled to a feed extension chamber 752 and a feed retraction chamber 754 of the feed mechanism 120. When the pulse signal indicates an extend signal, the feed valve 750 should connect the feed extension chamber 752 to the volume chamber 712. In response, the feed mechanism 120 should actuate to cause a proximate puck to be fed to the feed chute 140 as discussed above.

The feed valve 750 should cause the feed mechanism 120 to retract in response to a changed characteristic of the pulse signal. For example, when the pulse signal changes to indicate a retract signal, the feed valve 750 can toggle to connect the feed retraction chamber 754 to the volume chamber 712, while also disconnecting the extension chamber 752 from the volume chamber 712. This should cause the feed mechanism 120 to retract. The feed valve 750 should be configured to cause the feed mechanism 120 to extend according to the feed rate defined by the pulse signal.

The feed valve 750 can be coupled to a stop valve 755. Similar to the feed valve 750, the stop valve 755 can control connections of the volume chamber 712 to forward components of the system 700. As shown in FIG. 7, the stop valve 755 can be coupled to stop extension chambers 760 and stop retraction chambers 765 of the stoppers 180. Accordingly, the stop valve 755 can toggle to cause the stoppers 180 to extend and retract by controlling air pressure in the chambers 760, 765 in the same way discussed above in relation to the feed mechanism 120.

Upon receiving the extend signal, the stop valve 755 can cause the stopper plates 520 to extend to positions for catching the puck as the puck exits the feed chute 140. Specifically, when the extend signal is sent to stop valve 755, the stop valve 755 should toggle to connect the stop extension chambers 760 to the volume chamber 712. The air pressure then builds up at the stop extension chambers 760 and causes the stopper plates 520 of the stoppers 180 to extend into position for catching and leveling the puck as discussed above.

The stop valve 755 can also be coupled to a timer 770 that is coupled to a grip valve 775. As shown in FIG. 7, the stop valve 755 is coupled to the timer 770 such that the extend signal sent from the stop valve 755 to the stoppers 180 is also sent to the timer 770. Upon receipt of the extend signal, the timer 770 delays the extend signal approximately a predetermined interval before sending a maintained extend signal to the grip valve 775. By delaying the transmission of the maintained extend signal to the grip valve 775, the timer 770 provides sufficient time for the puck to be caught and leveled by the stoppers 180 before the grippers 185 extend to secure the puck. In some embodiments, the predetermined interval is approximately two to three seconds.

The grip valve 775 can be configured to cause the grippers 185 to actuate after the predetermined interval. As shown in FIG. 7, the grip valve 775 may be coupled to grip extension chambers 780 and grip retraction chambers 782 of the grippers 185. Accordingly, the grip valve 775 can toggle to cause the gripper 180 to extend and retract by controlling air pressure in the chambers 780, 785 in the same way discussed above in relation to the feed mechanism 120. This allows the grip valve 775 to cause the grippers 185 to extend to secure the puck while the puck is supported by the stopper plates 520. For example, when the maintained extend signal is sent to grip valve 775, the grip valve 775 should toggle to connect the grip extension chambers 780 to the volume chamber 712. Air pressure then builds up and causes the grippers 185 to extend to secure the puck.

Once the grippers 185 have secured the puck, the stoppers 180 can then retract. Accordingly, the control system 700 should be configured to cause the stoppers 180 to retract after the grippers 185 have had sufficient time to secure the puck. As shown in FIG. 7, the timer 770 can also be coupled to a flow controller 785 that is coupled to the stop valve 755. The timer 770 sends the maintained extend signal to the flow controller 785. The flow controller 785 may be configured to delay the maintained extend signal by an interval that provides the grippers 780 sufficient time to secure the puck. After this delay, the flow controller 785 sends the delayed extend signal to the stop valve 755.

The stop valve 755 should be configured to cause the stoppers 180 to retract in response to receiving the delayed extend signal from the flow controller 785. For example, the stop valve 755 can toggle to connect the stop retraction chambers 765 of the stoppers 180 to the volume chamber 712. A retract signal is then sent to the stoppers, causing air pressure to build up in the stop retraction chambers 765 such that the stopper plates 520 retract. When the stop valve 755 connects the stop retraction chambers 765 to the volume chamber 712, the stop extension chambers 760 should be disconnected from the volume chamber 712 such that air pressure is decreased in the stop extension chambers 760. This allows the stopper plates 520 to retract without being resisted by the air pressure of the volume chamber 712. Preferably, when the stop extension chambers 760 are disconnected from the volume chamber 712, the stop extension chambers 760 are connected to atmospheric pressure to sufficiently decrease the associated air pressure.

After the stopper plates 520 have retracted, the control system 700 can be configured to cause the grippers 185 to retract to release the puck. As shown in FIG. 7, the stop valve 755 can be coupled to a release timer 790 such that the retract signal sent from the stop valve 755 to the stoppers 180 is also received by the release timer 790. Similar to the timer 770, the release timer 790 can delay the retract signal approximately a predetermined interval before sending a delayed retract signal to the grip valve 775.

Upon receipt of the delayed retract signal, the grip valve 775 should cause the grippers 185 retract to release the puck as discussed above. In particular, the grip valve 775 should connect the grip retract chambers 782 to the volume chamber 712, causing air pressure to build up at the grip retract chambers 782 such that the grippers 185 retract. When the grip valve 775 connects the grip retraction chambers 782 to the volume chamber 712, the grip extension chambers 780 should be disconnected from the volume chamber 712 such that air pressure is decreased in the grip extension chambers 780. This allows the grippers 185 to retract without being resisted by the air pressure of the volume chamber 712. Preferably, when the grip extension chambers 780 are disconnected from the volume chamber 712, the grip extension chambers 780 are connected to atmospheric pressure to sufficiently decrease the air pressure in the grip extension chambers 780.

As discussed above, the puck is released when the grippers 185 retract. Preferably, the rate at which the pucks are released is variable. The release rate can be defined at least in part by the predetermined interval of delay provided by the release timer 790. Accordingly, the delay provided by the release timer 790 can be variable. For example, the release timer 790 may be accessible by the user for adjusting the predetermined interval. In some embodiments, the predetermined interval of delay is within a range of approximately one to five seconds.

In short, the control system 700 should be configured to cause the feed mechanism 120, the stoppers 180, and the grippers 185 to extend and retract at appropriate times to facilitate a feeding, a receiving, a securing, and a dropping of the puck. While the components shown in FIG. 7 illustrate one configuration of the control system 700, those skilled in the art will readily recognize that other configurations of the control system 700 can be implemented to cause the feed mechanism 120, the stoppers 180, and the grippers 185 to extend and retract at appropriate times.

Figure 8:
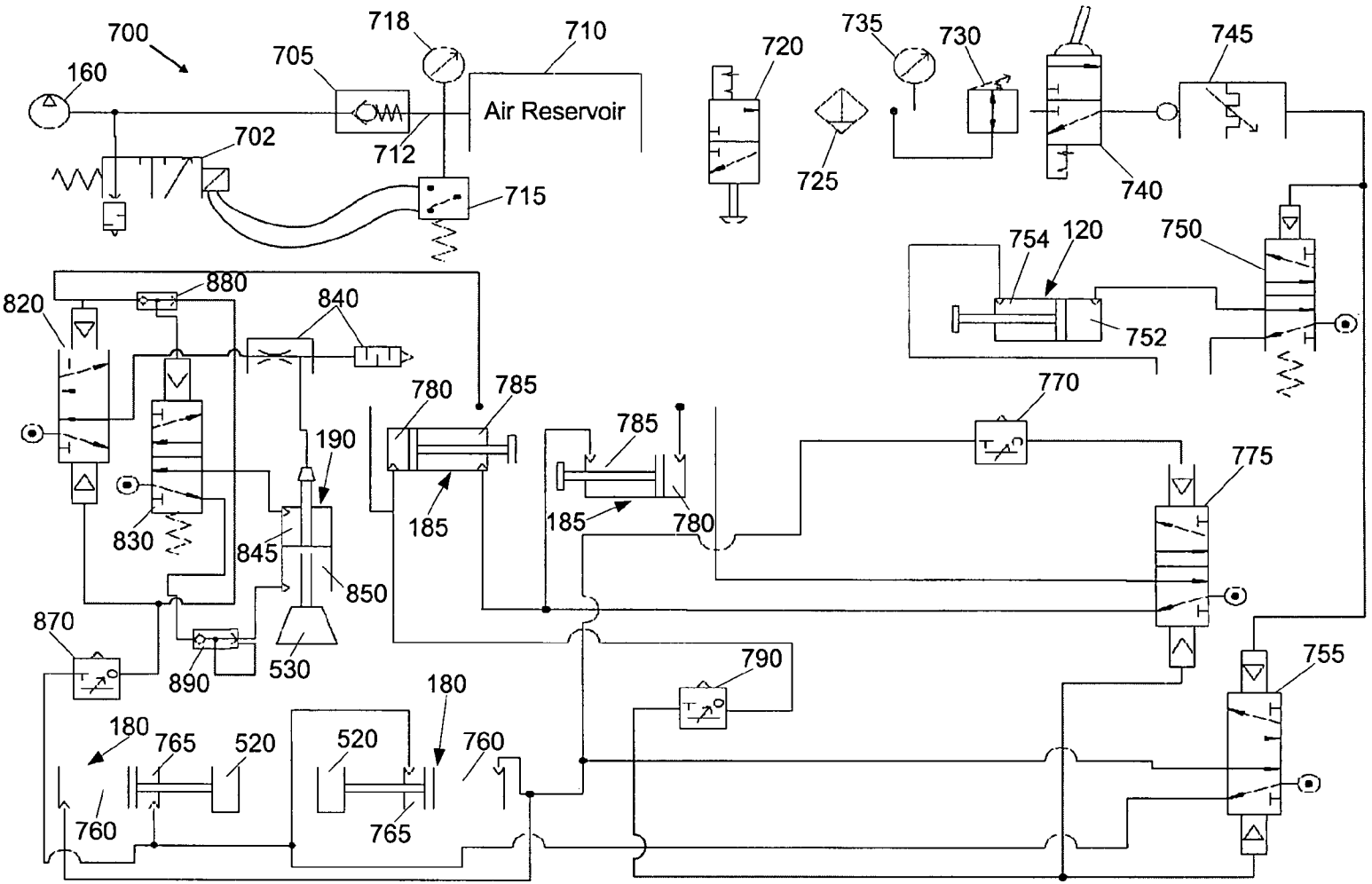
FIG. 8 is a circuit diagram illustrating an example of a control system and connected actuators, including a puck dropper.

FIG. 8 shows another control system 800 configured to control operation of the apparatus 100. In addition to providing many of the features of the control system 700, the control system 800 can control operation of the puck dropper 190. As shown in FIG. 8, many of the components of the control system 800 may be configured as described above in relation to the control system 700. For example, the components of the control system 800 from the compressor 160 to the feed mechanism 120 can be configured as discussed in relation to the control system 700 of FIG. 7.

As shown in FIG. 8, the pulse generator 745 may be configured to send the pulse signal to the stop valve 755. The stop valve 755 then toggles such that the stoppers 180 are caused to extend as discussed above. As in the control system 700, the stop valve 755 can also be configured to send the extend signal to the timer 770. The timer 770 can delay and send the maintained extend signal to the grip valve 775 as discussed above. Upon receipt of the maintained extend signal, the grip valve 775 causes the grippers 185 to extend to secure the puck as discussed above.

The control system 800 can include components for controlling the puck dropper 190. As shown in FIG. 8, the stop valve 755 and the grip valve 775 can be coupled to a vacuum valve 820 and a drop valve 830. The vacuum valve 820 may be coupled to a vacuum generator 840 that is coupled to the puck dropper 190. The drop valve 830 can also be coupled to the puck dropper 190. In particular, the drop valve 830 may be coupled to a drop extension chamber 845 and a drop retraction chamber 850 of the puck dropper 190.

The vacuum valve 820 and the drop valve 830 should be configured to cause the puck dropper 190 to timely secure and release the puck as discussed above. Accordingly, the vacuum valve 820 can receive the maintained extend signal from the grip valve 775. Upon receipt of the maintained extend signal, the vacuum valve 820 should toggle to cause the vacuum generator 840 to begin operating to form a vacuum. Specifically, when operating, the vacuum generator 840 works to form a vacuum at the suction member 530 of the puck dropper 190. When the suction member 530 contacts the puck, a vacuum is formed between the puck and the suction member 530. The vacuum should be of sufficient strength to secure the puck to the suction member 530.

The suction member 530 should be caused to timely extend to contact the puck such that the vacuum can be formed. As shown in FIG. 8, the drop valve 830 can receive the maintained extend signal. Upon receipt of this signal, the drop valve 830 should toggle to cause the suction member 530 to extend. In particular, the drop valve 830 can be coupled to the drop extension chamber 845. When the drop valve 830 toggles, the drop extension chamber 845 becomes connected to the volume chamber 712 such that air pressure causes the suction member 530 to extend to contact the puck. When the suction member 530 contacts the puck, a vacuum forms to secure the puck as discussed above.

Preferably, the puck is secured by the suction member 530 when the puck is being held by the grippers 185. This allows the puck to be consistently centered when secured by the suction member 530. By being consistently centered with relation to the suction member 530, the pucks can be released at a substantially level orientation as discussed above. Further, by centering the puck, an acceleration force applied to the puck is centered such that the force does not cause the puck to rotate away from its substantially level orientation as it descends.

The control circuit 800 can be configured such that the stoppers 180 and the grippers 185 retract after the puck has been secured by the suction member 530. As shown in FIG. 8, the grip valve 775 is coupled to the release timer 790 such that the release timer 790 may receive the maintained extend signal. Upon receiving the maintained extend signal, the release timer 790 delays the signal as discussed above in relation to FIG. 7. The delay should be sufficient to allow the puck dropper 190 to secure the puck as discussed above.

After delaying the maintained extend signal, the release timer 790 sends the delayed signal to the stop valve 755. Upon receipt of the delayed signal, the stop valve 755 should toggle to connect the stop retraction chambers 765 of the stoppers 180 and the grip retraction chambers 782 of the grippers 185 to the volume chamber 712. The stop extension chambers 760 of the stoppers 180 and the grip extension chambers 780 of the grippers 185 should correspondingly be disconnected from the volume chamber 712. This causes the stoppers 180 and grippers 185 to retract, leaving the puck secured to the puck dropper 190.

After the stoppers 180 and the grippers 185 have retracted, the control system 800 may cause the suction member 530 to retract to raise the puck. For example, when the grip valve toggles to retract the grippers 185, the maintained extend signal is terminated, and the drop valve 830 toggles to connect the drop retraction chamber 850 to the volume chamber 712. The drop valve 830 should also disconnect the drop extension chamber 845 from the volume chamber 712. In response, air pressure builds up in the drop retraction chamber 850 such that the suction member 530 retracts, raising the secured puck.

The control system 800 can be configured to cause the puck dropper 190 to drop the puck after a predetermined interval. For example, a drop timer 870 can be configured to receive the retract signal from the stop valve 755. As shown in FIG. 8, the drop timer 870 is coupled to the stop valve 755. Upon receipt of the retract signal, the drop timer 870 delays the retract signal approximately the predetermined interval before sending the delayed retract signal forward. Similar to the release timer 790, the drop timer 870 can be variable. For example, the drop timer 870 may be accessible to and adjustable by the user of the apparatus 100. In some embodiments, the predetermined interval can be varied within an approximate range of one to five seconds.

The vacuum valve 820 and the drop valve 830 can be configured to cause the puck dropper 190 to drop the puck upon receiving the delayed retract signal. As shown in FIG. 8, the drop timer 870 may be coupled to the vacuum valve 820 and the drop valve 830. The drop valve 830 is coupled to the drop timer 870 via an exhaust control 880. The exhaust control 880 is configured to generally stop air from flowing backwards through volume chamber 712. This allows the delayed retract signal to form sufficient air pressure to cause the drop valve 830 to toggle.

When the drop valve 830 toggles responsive to the delayed retract signal, the drop extension chamber 845 is connected to the volume chamber 712. In response, air pressure quickly builds up in the drop extension chamber 845 such that the suction member 530 extends, pushing the puck generally downward. The drop valve 830 should also disconnect the drop retraction chamber 850 from the volume chamber 712 to release resistive air pressure from the drop retraction chamber 850.

Further, the suction member 530 should be configured to extend quickly. For example, the drop valve 830 can be coupled to the drop retraction chamber 850 via a quick exhaust 890. The quick exhaust 890 should be configured to facilitate a quick escape of air from the drop retraction chamber 850 to help minimize any resistance to the extension of the suction member 530. Accordingly, the suction member 530 can extend to help accelerate the puck generally downward.

When the vacuum valve 820 toggles responsive to the delayed retract signal, the vacuum generator is turned off. Accordingly, the vacuum at the suction member 530 is terminated. This allows the puck to be accelerated by the suction member 530 quickly extending downward as discussed above.

Further, an air blast can be applied to the puck to help accelerate the puck downward. When the vacuum valve 820 toggles responsive to the delayed retract signal, the puck dropper 190 can be connected to the volume chamber 712. This allows the air pressure of the volume chamber 712 to apply a force to the puck to accelerate the puck downward.

Thus, the vacuum valve 820 and the drop valve 830 should be configured to work together to control the puck dropper 190. Further, by using the puck dropper 190 in combination with the grippers 185, the apparatus 100 can repeatedly and consistently drop a puck toward a playing surface at a substantially horizontal orientation. As discussed above, such a substantially flat orientation is preferred when dropping the puck for a hockey face-off.

The control systems 700, 800 can be configured to continue to cycle to drop one puck at a time toward the playing surface. The control systems 700, 800 may be configured to stop cycling after losing sufficient air pressure from the volume chamber 712. The control systems 700, 800 can also be configured stop cycling after the feed switch 740 is turned "off," the emergency switch 720 is turned "off," or the supply of pucks in the puck housing 130 is exhausted.

II. PROCESS FLOW VIEWS

Figure 9:
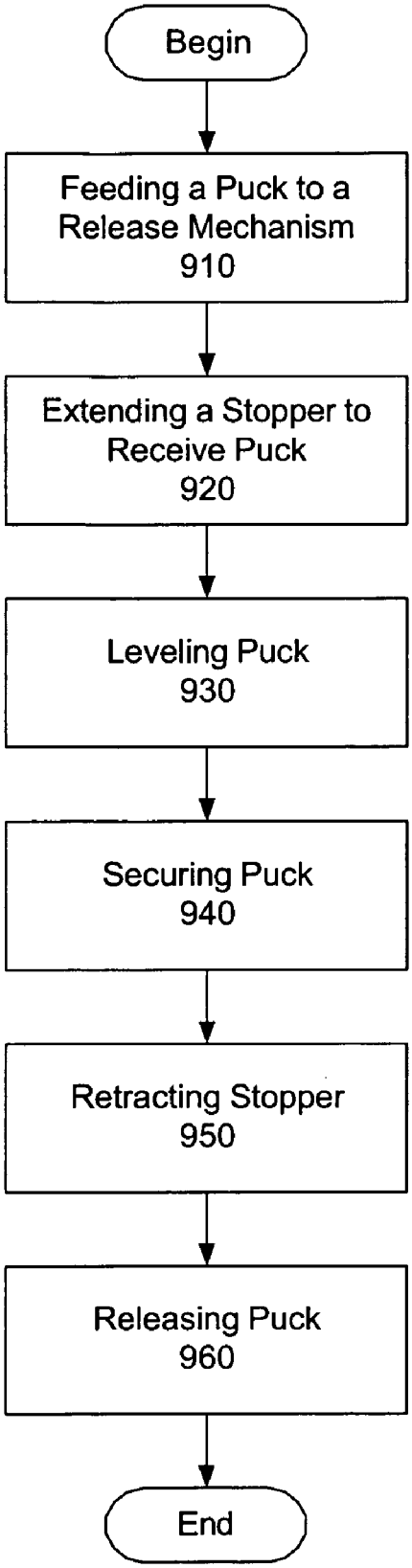
FIG. 9 is a flow chart diagram illustrating an example of a process for dropping a puck for facilitating a hockey face-off.

FIG. 9 is a flow chart diagram illustrating an example of a process for dropping a puck for facilitating a hockey face-off. At step 910, a puck is fed to the release mechanism 150. The puck can be fed to the release mechanism 150 in any of the ways discussed above, including the feed mechanism 120 feeding the puck to the feed chute 140. At step 920, the stoppers 180 are extended to receive the puck from the feed chute 140 as discussed above. At step 930, the puck can be leveled as discussed above. At step 940, the puck is secured in any of the ways discussed above. For example, the grippers 185 can extend to grip the puck, and/or the suction member 530 may extend to form a vacuum at the puck. At step 950, the stoppers 180 are retracted as discussed above. At step 960, the puck can be released in any of the ways discussed above, including by retracting the grippers 185 and/or destroying the vacuum at the suction member 530. The steps 910–960 shown in FIG. 9 can be repeated until the puck housing 130 is emptied of all pucks. The operator can configure the apparatus to deploy a predetermined number of pucks over a predetermined period of time, with a predetermined interval of time between deployments.

Figure 10:
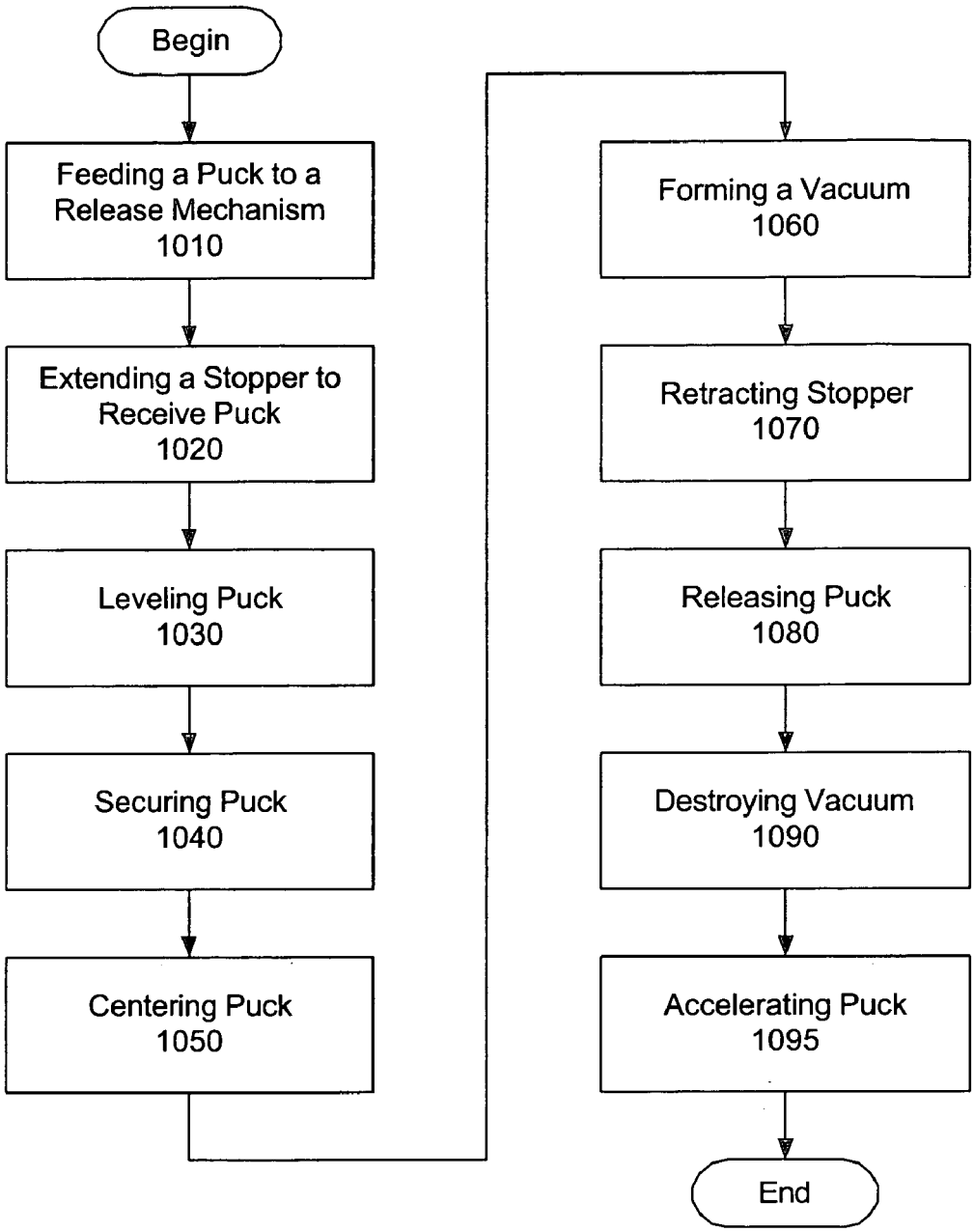
FIG. 10 is a flow diagram illustrating an example of a process for dropping a puck for facilitating a hockey face-off.

FIG. 10 is a flow diagram of another example of a process for dropping a puck for facilitating a hockey face-off. The puck can be fed to the release mechanism 150 (step 1010), received by an extended stopper 180 (step 1020), leveled (step 1030), and secured (step 1040) in any of the ways discussed above in relation to steps 910–940. At step 1050, the puck can be centered, preferably with respect to the puck dropper 190 as discussed above. At step 1060, a vacuum may be formed at the suction member 530. The suction member 530 can be extended to contact and secure the puck as discussed above. At step 1070, the stopper 180 can be retracted as discussed above. At step 1080, the puck can be released by retracting the grippers 185 as discussed above. At step 1090, the vacuum can be destroyed as discussed above, thereby dropping the puck toward a playing surface. At step 1095, the puck can be accelerated toward the playing surface in any of the ways discussed above, including an air blast and/or a quick extension of the suction member 530 toward the playing surface. Steps 1010–1095 may repeat until the puck housing 130 is exhausted of pucks.

III. ALTERNATIVE EMBODIMENTS

The foregoing embodiments were chosen and described in order to illustrate principles of the methods and apparatuses as well as some practical applications. The preceding description enables others skilled in the art to utilize the methods and apparatuses in various embodiments and with various modifications as are suited to the particular use contemplated. It is intended that the scope of the methods and apparatuses be defined by the following claims, including the full scope of equivalents to which such claims are entitled. In accordance with the provisions of the patent statutes, the principles and modes of operation of the present methods and apparatuses have been explained and illustrated in exemplary embodiments. However, it must be understood that the present methods and apparatuses may be practiced otherwise than is specifically explained and illustrated without departing from their spirit or scope.

What is claimed is:

1. An apparatus for dropping a hockey puck, comprising:
- a frame, wherein said frame is moveable;
- a power supply, wherein said power supply is carried by said frame;
- a puck housing supported by said frame and configured to house said hockey puck;
- a feed chute;
- a feed mechanism supported by said frame and configured to feed said hockey puck from said puck housing to said feed chute; and
- a release mechanism configured to receive said hockey puck from said feed chute and to downwardly release said hockey puck from the apparatus in a generally vertical direction, wherein said feed and said release of said hockey puck are powered by said power supply, and wherein said release mechanism is configured to facilitate a leveling of said hockey puck such that said hockey puck is oriented so as to be generally horizontal when released from the apparatus in the generally vertical direction.

2. The apparatus of claim 1, wherein said frame includes a stow assembly configured to stow said feed chute.

3. The apparatus of claim 1, further including a plurality of pneumatic actuators, wherein said feed mechanism and said release mechanism include said pneumatic actuators.

4. The apparatus of claim 3 further comprising an air compressor supported by said frame and configured to provide air for said pneumatic actuators.

5. The apparatus of claim 1, further comprising a release rate, wherein the release of said hockey puck is influenced by said release rate.

6. The apparatus of claim 5 wherein said release rate is variable.

7. The apparatus of claim 1, wherein said feed chute includes a first end coupled to said frame and a second end coupled to said release mechanism, said feed chute extending laterally away from said frame and sloping generally downward from said first end to said second end.

8. The apparatus of claim 1, wherein said release mechanism comprises:
- a stopper configured to extend to receive and to facilitate a leveling of said hockey puck; and
- a gripper configured to secure said hockey puck while said stopper is extended, wherein said gripper is configured to release said hockey puck at a predetermined interval after said stopper has retracted.

9. An apparatus for dropping a hockey puck, comprising:
- a frame;
- a puck housing supported by said frame and configured to house said hockey puck;
- a feed chute;
- a feed mechanism supported by said frame and configured to feed said hockey puck from said puck housing to said feed chute;

a stopper configured to extend to receive said hockey puck from said feed chute and to facilitate a leveling of said hockey puck; and a gripper configured to secure said hockey puck while said stopper is extended and to downwardly release said hockey puck from the apparatus in a generally vertical direction after said stopper has retracted, wherein said hockey puck is oriented so as to be substantially horizontal when released from the apparatus in a generally vertical direction.

10. The apparatus of claim 9 wherein said frame includes a stow assembly configured to stow said feed chute.

11. The apparatus of claim 9 further comprising a plurality of pneumatic actuators, wherein said feed mechanism, said stopper, and said gripper include said pneumatic actuators.

12. The apparatus of claim 11 further comprising an air compressor supported by said frame and configured to provide air for said pneumatic actuators.

13. The apparatus of claim 9 wherein said feed chute extends laterally away from said frame and includes:

a first end for receiving said hockey puck from said puck housing; and a second end for delivering said hockey puck to said stopper, wherein said feed chute slopes generally downward from said first end to said second end.

14. The apparatus of claim 9 further comprising a power source supported by said frame, said power source configured to provide power for said feed and said release of said hockey puck.

15. The apparatus of claim 9 wherein said hockey puck is released after a predefined interval of time.

16. The apparatus of claim 15 wherein said predefined interval of time is defined by an operator of the apparatus.

17. The apparatus of claim 9 further comprising a plurality of hockey pucks, wherein said puck housing includes said plurality of hockey pucks, and wherein each said hockey puck is released after a predefined interval of time.

18. An apparatus for dropping a hockey puck, comprising:

a frame, wherein said frame is moveable;

a power supply, wherein said power supply is carried by said frame;

a puck housing supported by said frame and configured to house said hockey puck;

a feed chute;

a feed mechanism supported by said frame and configured to feed said hockey puck from said puck housing to said feed chute; and a release mechanism configured to receive said hockey puck from said feed chute and to release said hockey puck, wherein said feed and said release of said hockey puck are powered by said power supply, and wherein said release mechanism comprises a puck dropper, wherein said puck dropper is configured to form a vacuum to secure said hockey puck and to destroy said vacuum to release said hockey puck.

19. The apparatus of claim 18 wherein said puck dropper is configured to accelerate said hockey puck by directing air at said hockey puck.

20. The apparatus of claim 18 wherein said release mechanism is configured to center said hockey puck relative to said puck dropper.

21. An apparatus for dropping a hockey puck, comprising:

a frame;

a puck housing supported by said frame and configured to house said hockey puck;

a feed chute;

a feed mechanism supported by said frame and configured to feed said hockey puck from said puck housing to said feed chute;

a stopper configured to extend to receive said hockey puck from said feed chute and to facilitate a leveling of said hockey puck; and a gripper configured to secure said hockey puck while said stopper is extended and to release said hockey puck after said stopper has retracted, and further comprising a puck dropper, said puck dropper configured to form and destroy a vacuum to receive said hockey puck from said gripper and to release said hockey puck.

22. The apparatus of claim 21 wherein said puck dropper is configured to accelerate said hockey puck by focusing air at said hockey puck.

23. The apparatus of claim 21 wherein said gripper is configured to center said hockey puck relative to said puck dropper.

24. The apparatus of claim 23 wherein said gripper comprises substantially oppositely oriented angled edges configured to extend to center said hockey puck relative to said puck dropper.

* * * * *